US011105584B2

(12) United States Patent
Rogers et al.

(10) Patent No.: US 11,105,584 B2
(45) Date of Patent: Aug. 31, 2021

(54) ARTICULATED TRIGGER GUARD BLOCKING DEVICE

(71) Applicant: Safariland, LLC, Jacksonville, FL (US)

(72) Inventors: William H. Rogers, St. Augustine, FL (US); Dylan Vaccaro, Jacksonville, FL (US); Matthew E. McKendrick, Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 16/774,802

(22) Filed: Jan. 28, 2020

(65) Prior Publication Data

US 2020/0240744 A1 Jul. 30, 2020

Related U.S. Application Data

(60) Provisional application No. 62/798,177, filed on Jan. 29, 2019.

(51) Int. Cl.
*F41C 33/02* (2006.01)

(52) U.S. Cl.
CPC ..... *F41C 33/0227* (2013.01); *F41C 33/0245* (2013.01)

(58) Field of Classification Search
CPC ..... F41C 33/0227; F41C 33/0245; F41C 33/0254; F41C 33/0236; F41C 33/0263; F41C 33/0209; F41C 33/0272; Y10S 224/911
USPC ..... 224/244, 193, 912, 243
See application file for complete search history.

(56) References Cited

U.S. PATENT DOCUMENTS 5,284,281 A * 2/1994 Nichols ..... F41C 33/0227 224/193
6,948,644 B1 * 9/2005 Beletsky ..... F41C 33/0227 224/193

* cited by examiner

*Primary Examiner* — Nathan J Newhouse
*Assistant Examiner* — Matthew T Theis
(74) *Attorney, Agent, or Firm* — Kane Kessler, P.C.; Paul E. Szabo

(57) ABSTRACT

A holster for a handgun having a trigger guard includes a holster body defining a chamber for receiving a portion of the handgun. The holster body has an entranceway enabling insertion of the gun into the holster and removal of the handgun from the holster chamber. The holster includes a blocking device separate from the holster body that helps to block movement of the handgun trigger guard relative to the holster body when the handgun is in the chamber. The blocking device is supported on the holster body for movement relative to the holster body between an open position and a blocking position. The blocking device has a tail portion that projects from the bottom wall in a direction away from the top wall when the blocking member is in the open position. The blocking device moves from the open position to the blocking position in response to insertion of a handgun through the entranceway into the chamber. The blocking device tail portion moves in a direction toward the holster top wall during movement of the blocking device from the open position to the blocking position.

7 Claims, 7 Drawing Sheets

ARTICULATED TRIGGER GUARD BLOCKING DEVICE

BACKGROUND AND SUMMARY OF THE INVENTION

Some handgun holsters are configured to include a trigger guard engagement portion on their bottom wall, which engages and blocks movement of the handgun trigger guard when the handgun is holstered, to help to stabilize the handgun in the holster.

Some handguns have a light secured to the handgun, often at a position below the barrel. The light extends downward from the barrel, often to a distance below the bottom of the trigger guard. For such a handgun assembly, if the holster is tall (deep) enough to receive the light with clearance, then the bottom wall of the holster is far enough away from the top wall so that, when the handgun is inserted into the holster, there may be no engagement between the holster and the trigger guard of the handgun. As a result, the stabilizing benefit described above may not be provided. In addition, if the holster is thus large enough to accommodate the handgun assembly that includes the light, the opening into the holster may provide easier access to the trigger, than is desired.

DESCRIPTION OF AN EMBODIMENT OF THE INVENTION

The present invention is applicable to handgun holsters of varying and different configurations. As representative of the invention, the drawings illustrate a handgun holster 10 that is a first embodiment of the invention. The invention is, of course, not limited to the illustrated embodiment but rather is defined by the claims.

Figure 2:
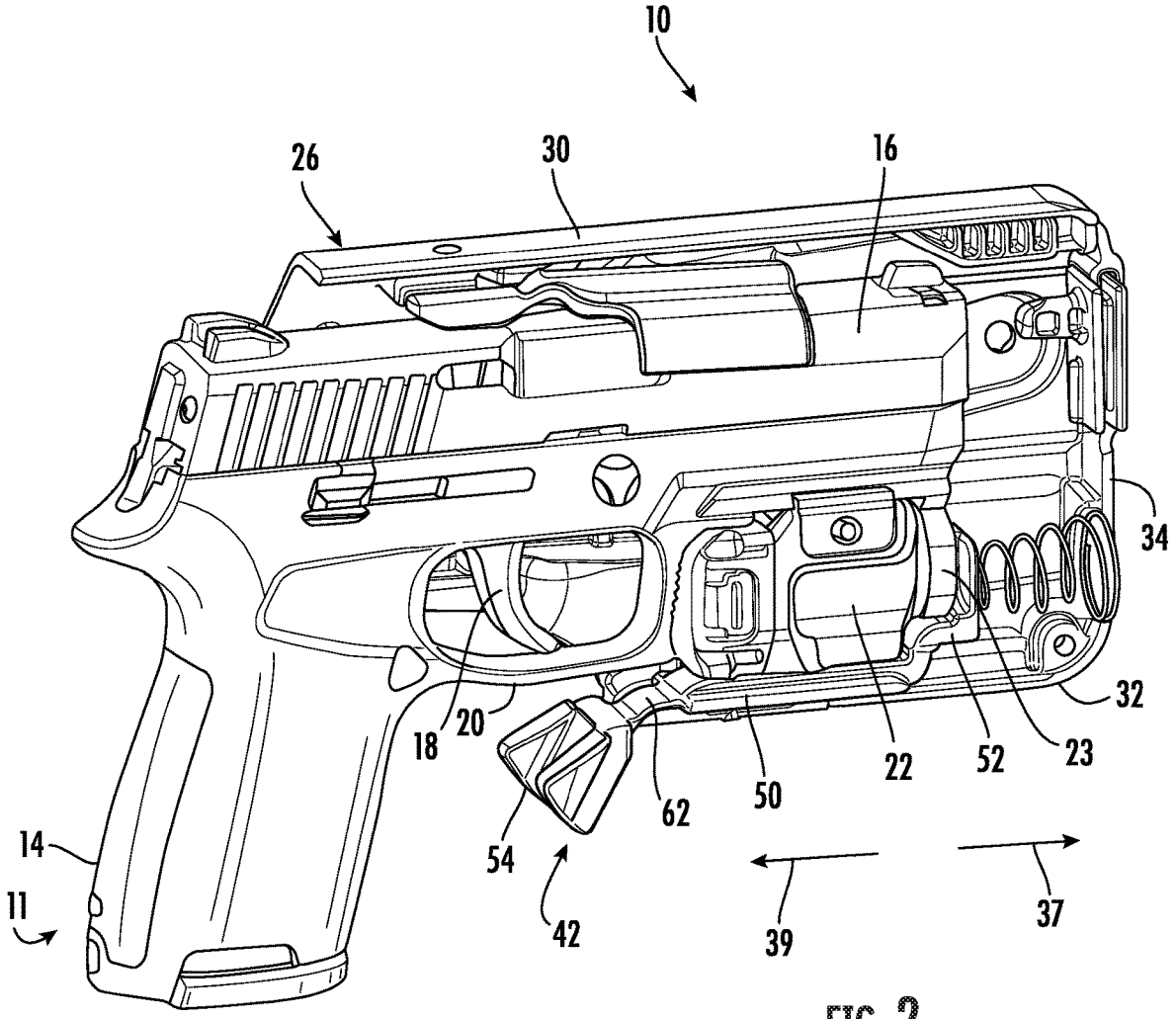
FIG. 2 is a perspective view similar to FIG. 1 and also showing a handgun assembly, including a light, in a position having just been inserted into the holster of FIG. 1, before the blocking device is actuated.
Figure 3:
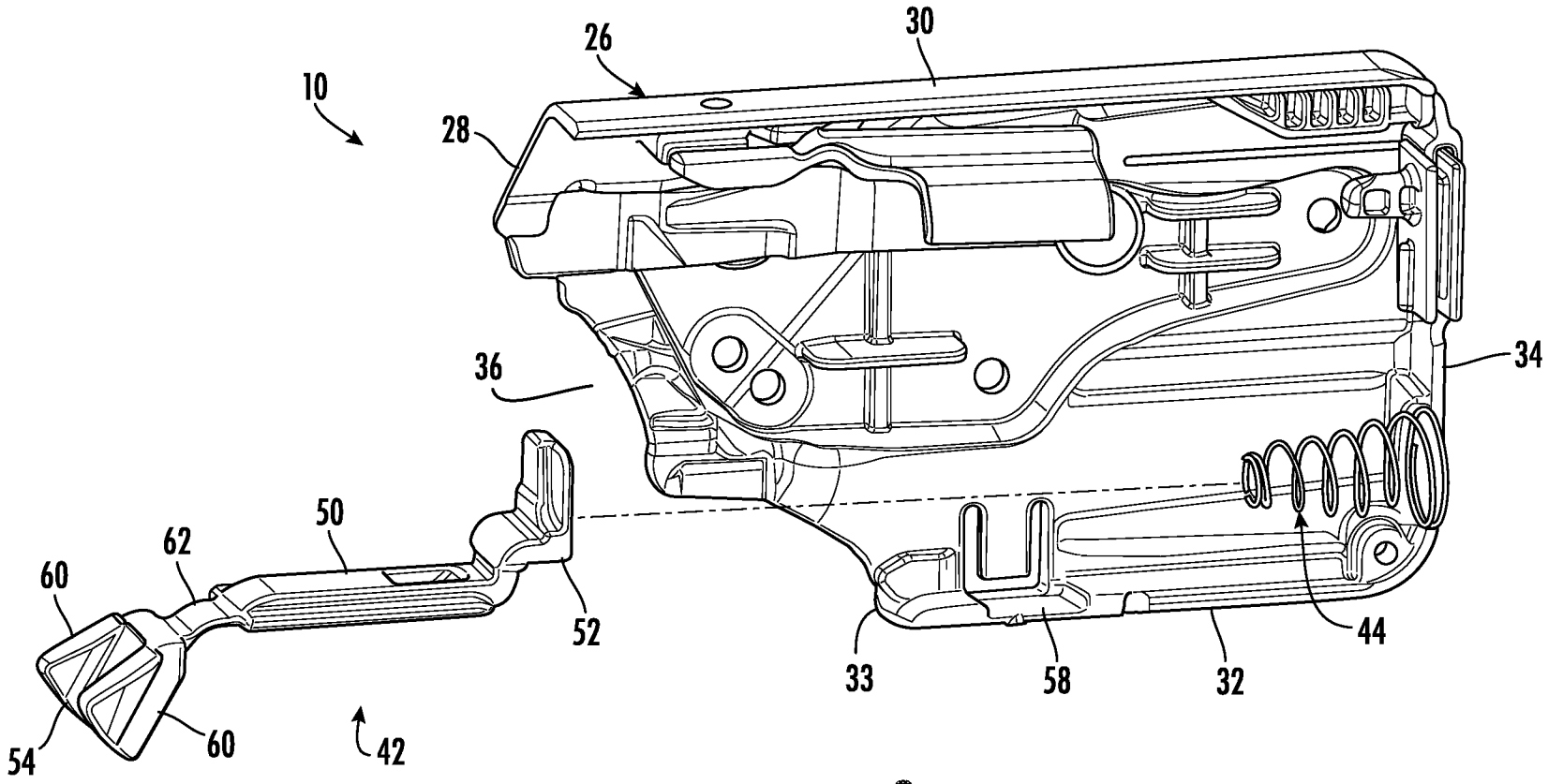
FIG. 3 is an exploded view of the holster body and blocking device.

The holster 10 is configured for use with a handgun assembly 11 that includes a handgun 12 (FIG. 2). The illustrated handgun 12 is a semi-automatic handgun having a grip 14, a barrel 16, a trigger 18, and a trigger guard 20. A holster in accordance with the present invention could be used with a different type or style of handgun.

The handgun assembly 11 also includes a light 22 that is mounted on the handgun 12, in a position below the barrel 16. The light 22 has a forward end portion 23. The light 22 hangs down below the trigger guard 20. As a result, the handgun is taller (up and down as viewed in FIG. 2) at the location of the light 22, than it is at the location of the trigger guard 20.

Figure 1:
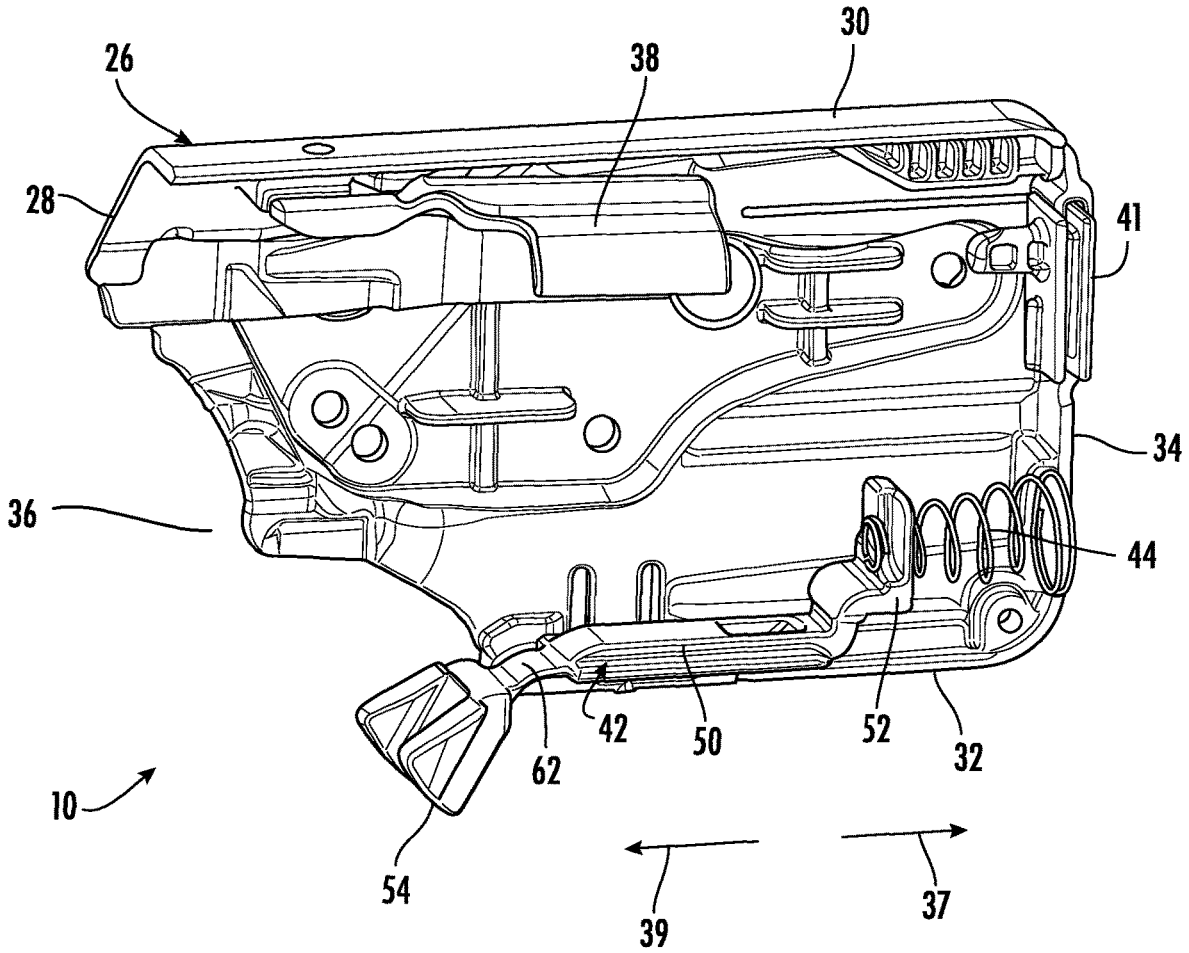
FIG. 1 is a cutaway perspective view of a holster that is an embodiment of the invention, including a holster body and a stabilizing mechanism that includes an articulated trigger guard blocking device.

The holster 10 (FIG. 1) includes a holster body 26. The holster body 26 has two side walls 28 and 29; a top wall 30; a bottom wall 32; and an end wall 34. (The terms "top" and "bottom" are not absolute as used herein but rather are used with reference to the drawings; when a holster is in use, the designated "top" wall of the holster is typically forward, with the barrel of the gun pointing downward.

The holster walls define a chamber 35 for receiving the handgun 12. The end of the holster body 26 opposite from the end wall 34 has an opening or entranceway 36 (FIGS. 1, 7, and 8) through which the handgun 12 may be inserted into the chamber 35, in an insertion direction 37 that is to the right as viewed in FIG. 2 or into the plane of the paper as viewed in FIGS. 7 and 8. The handgun 12 may be removed from the chamber 35 in an opposite removal direction 37, in a direction to the left as viewed in FIG. 2, or out of the plane of the paper as viewed in FIGS. 7 and 8. The bottom wall 32 of the holster body 26 has an edge 33 adjacent to and partially defining the entranceway 36.

In the illustrated holster 10, the holster top wall 30 and side walls 28 and 29 support a handgun locking mechanism 38 which may be, for example, of the type shown in U.S. Pat. No. 6,769,581. This locking mechanism 38 engages the handgun 12 adjacent its ejection port, and prevents inadvertent or unwanted removal of the handgun from the holster 10. The present invention is applicable to holsters with or without locking mechanisms. The holster 10 may also include a muzzle plug as illustrated at 41 for added stability of the handgun in the holster.

The holster 10 includes a stabilizing mechanism for helping to stabilize the handgun assembly in the holster. The stabilizing mechanism includes an articulated trigger guard blocking device 42, and a spring 44. The blocking device 42 and the spring 44, acting together with the holster body 26, help to stabilize the handgun assembly in the holster 10 and also help to impede access to the trigger, in a manner as described below.

The blocking device 42 is supported in the holster body 26, between the side walls 28 and 29, for sliding movement along the bottom wall 32 of the holster body 26. The blocking device 42 has an elongate configuration including a central portion 50. The central portion 50 of the blocking device 42 is configured to engage and slide along either or both of the side walls 28 and the bottom wall 32 of the holster body 26. The blocking device 42 in the illustrated embodiment is molded from Delrin brand plastic. Other suitable materials and/or manufacturing methods may be used.

The blocking device 42 has an inner end portion 52 that is located farther from the entranceway 36 and closer to the holster end wall. An opposite outer end portion 54 of the blocking device 42 is located closer to the entranceway 36 and farther from the holster end wall.

A stop member 56 (FIG. 4) on the bottom of the blocking device central portion 50 prevents removal of the blocking device 42 from the holster body 26 during ordinary usage. The stop member 56 is releasable via an opening 58 in the bottom wall 32 of the holster body 26 should the blocking device need to be removed or replaced.

The inner end portion 52 of the blocking device 42 is configured as a spring flange for engagement with the spring 44, as described below. The spring flange 52 extends generally perpendicular to the length of the blocking device 42.

The spring flange 52 is fixed to and moves directly with the central portion 50 of the blocking device 42.

The outer end portion 54 of the blocking device 42 has a upwardly-opening U-shaped configuration with two side walls 60 and a bottom wall 61. The outer end portion 54 is connected by a flexible connector portion 62 to the central portion 50 of the blocking device 42.

The spring 44 helps to control the position of the blocking device 42 in the holster body 26. In the illustrated embodiment, the spring 44 is a conical compression spring made from metal. The base of the spring 44 is set against the end wall 34 of the holster body 26. The tip of the spring 44 is set against, and may be connected for movement with, the spring flange 52 of the blocking device 42. The spring 44 biases the blocking device 42 for movement relative to the holster body 26, in the removal direction away from the end wall 34 and toward the entranceway 36.

When the handgun is not in the holster 10 (FIG. 1), the spring 44 urges the blocking device 42 in the removal direction (to the left as viewed in the drawings), away from the end wall 34 and toward the holster entranceway 36. The stop member 56 on the blocking device 42 engages the bottom wall 32 of the holster body 26 to prevent the blocking device from coming out of the holster body. The molded configuration of the connector portion 62 of the blocking device 42, when in this free state, biases the outer end portion 54 of the blocking device 42 downward from the bottom wall 32 of the holster body 26 as it extends outward, away from the top well 30 of the holster body. This frees up space in the entranceway 36 for the handgun trigger guard 20.

Figure 4:
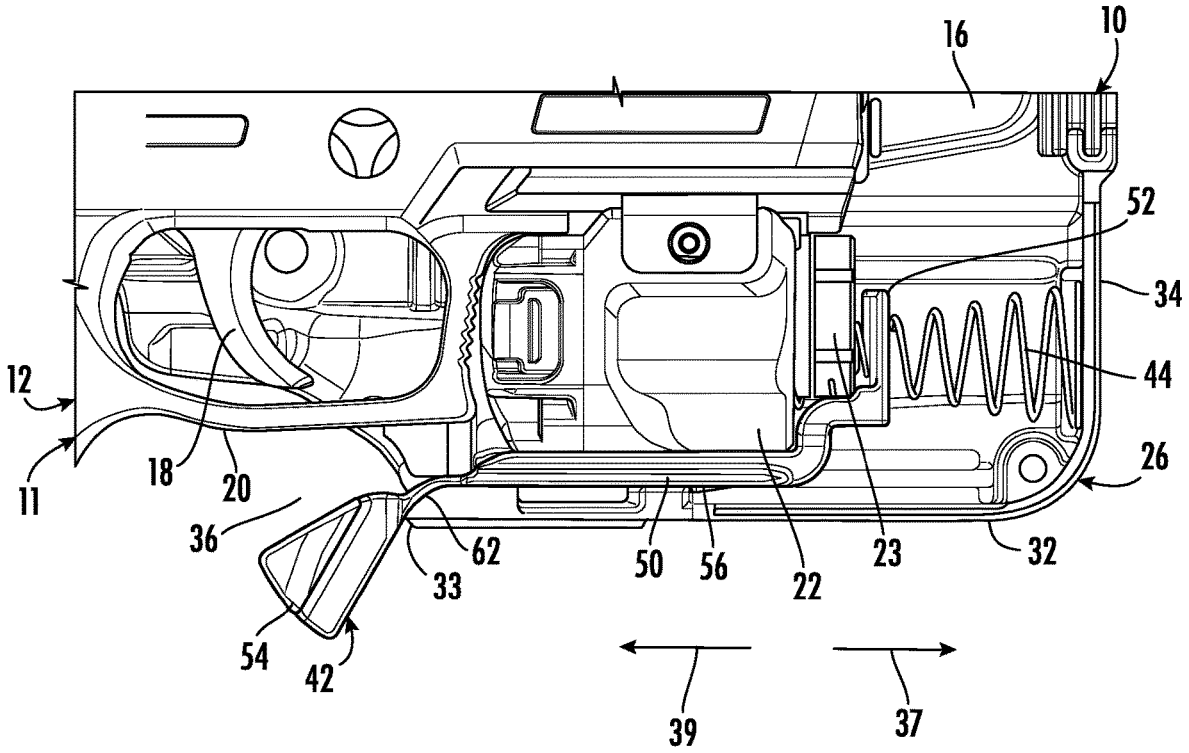
FIG. 4 is an enlarged cutaway elevational view of the holster and handgun when they are in the position of FIG. 2.
Figure 7:
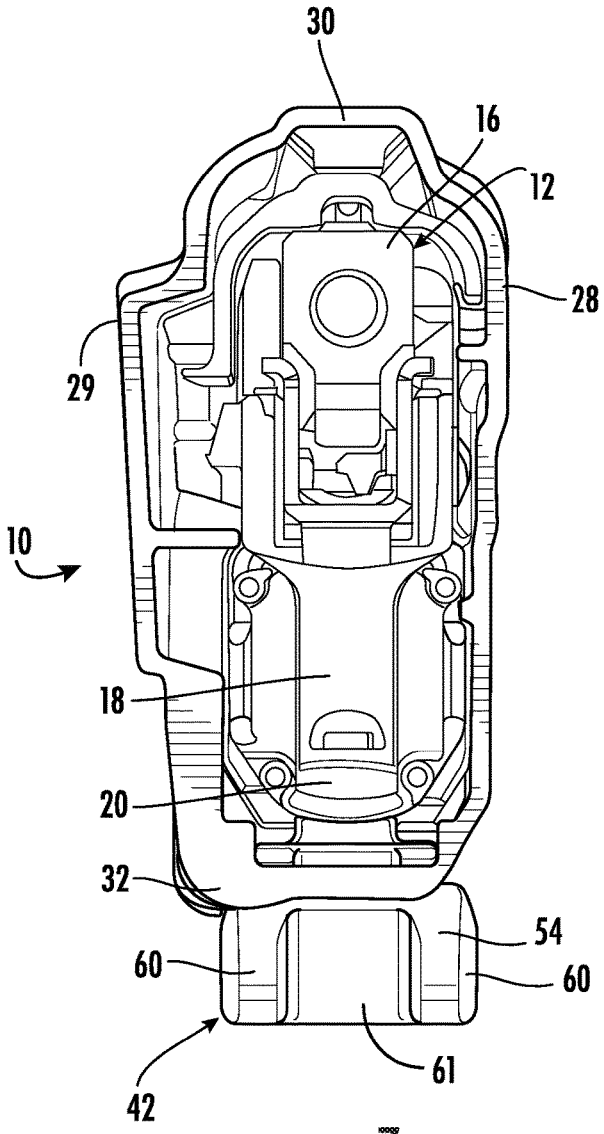
FIG. 7 is a cutaway end view of the holster and handgun when they are in the partially inserted position of FIG. 2.

FIGS. 2, 4, and 7 show the same parts in a position with the handgun 12 partially inserted into the holster 10, that is, before the blocking device 40 is actuated. The light 22, which is supported under the handgun barrel 16, has moved over the top (inside) of the blocking device central portion 50, and the forward-most end 23 of the light engages the spring flange 52 of the blocking device 42. The blocking device 42 has not moved in the insertion direction 37. The outer end portion 54 of the blocking device 42 is still located below the bottom wall 32 of the holster body 26, away from the trigger guard 20 of the handgun 12 and out of the chamber 35, by the inherent bias of the connector portion 62.

Figure 5:
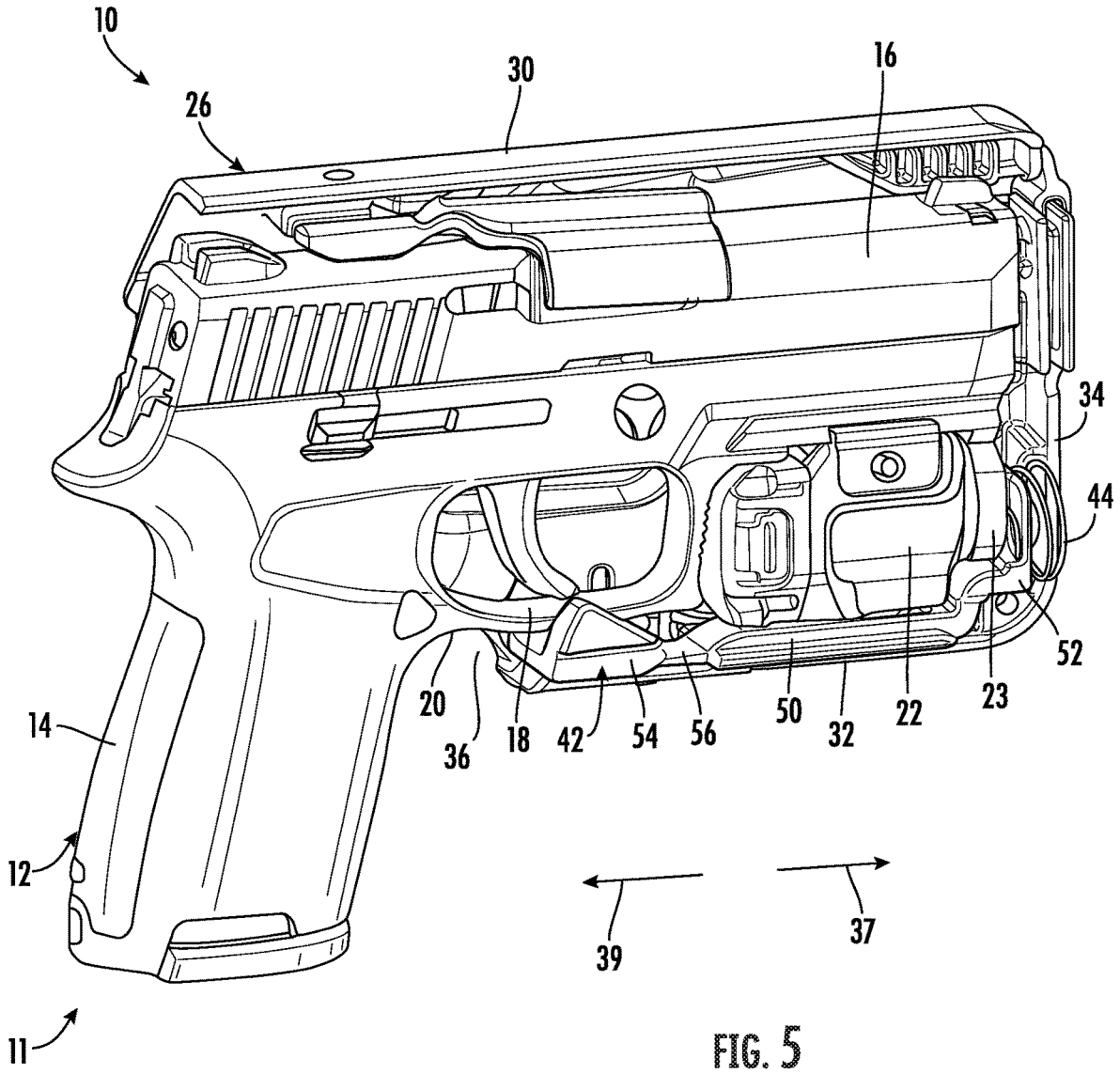
FIG. 5 is a perspective view similar to FIG. 2 but showing the handgun/light in a position after being fully inserted into the holster, and the blocking device fully engaged.
Figure 6:
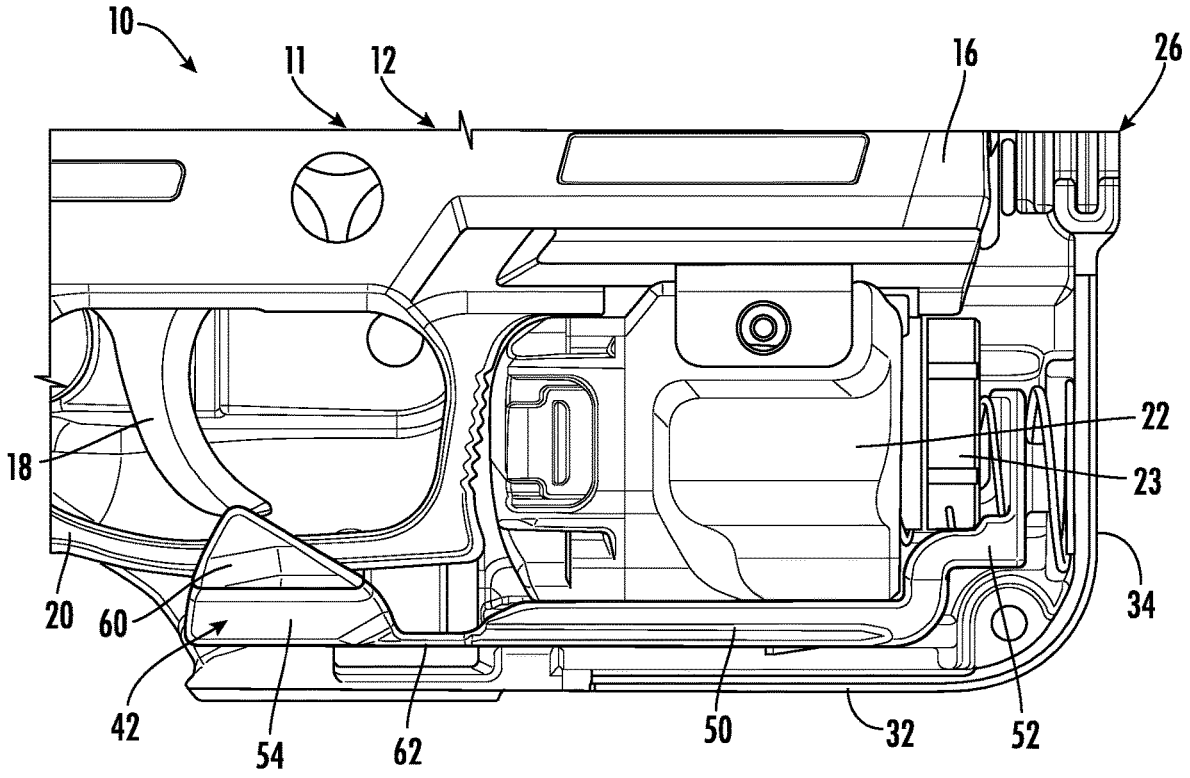
FIG. 6 is an enlarged cutaway elevational view of the holster and handgun when in the position of FIG. 5.
Figure 8:
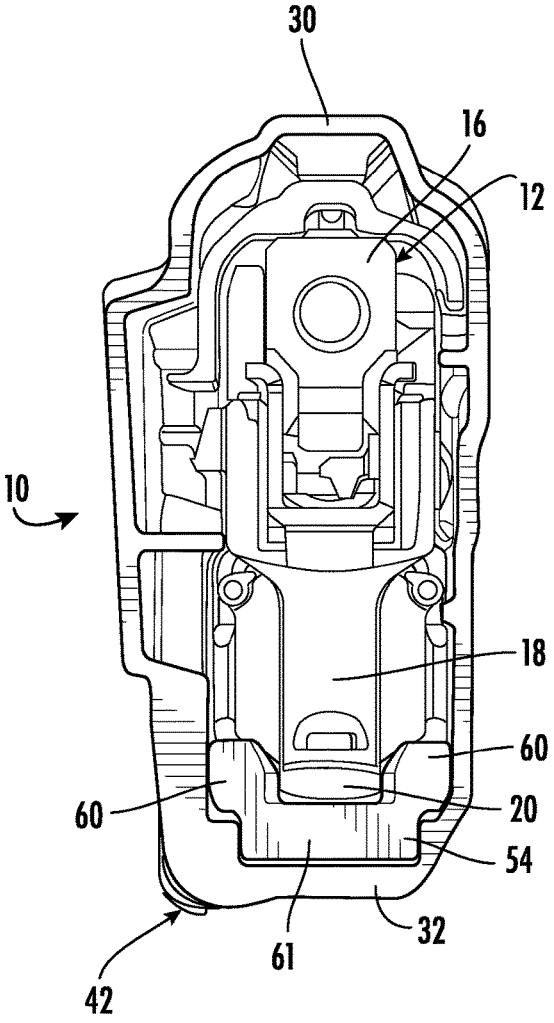
FIG. 8 is a cutaway end view of the holster and handgun when they are in the fully inserted position of FIG. 5.

FIGS. 5, 6, and 8 show the handgun 12 and holster 10 in a position in which the handgun is inserted fully into the holster. The insertion of the handgun 12 has caused the forward end portion 23 of the light 22 to engage and move the blocking device 42 in the insertion direction 37. This movement of the blocking device 42 compresses the spring 44. The inner end portion 52 of the blocking device 42 is moved to a position adjacent to the end well 32 of the holster body 26.

The inward movement of the blocking device 42 causes its flexible connector portion 62 to engage the edge 33 on the holster bottom wall 32 and be cammed upward toward the trigger guard 20 of the handgun 12. The outer end portion 54 of the blocking device 40 moves into the chamber 35 and into engagement with the trigger guard 20 of the handgun 12. The outer end portion moves simultaneously both (i) in the insertion direction 37 and (ii) upward toward the top wall and/or into the holster chamber. Specifically, the side walls 60 of the outer end portion 54 move into a position on opposite sides of and in engagement with the trigger guard 20 of the handgun 12. The bottom wall 61 of the outer end portion 54 of the blocking device 42 engages with the bottom of the trigger guard 20 of the handgun 12. Also, the bottom wall 61 of the outer end portion 54 engages the bottom wall 34 of the holster body 26. As a result, the outer end portion 54 of the blocking device is captured between the bottom wall 34 of the holster body 26 and the trigger guard 20 of the handgun 12. With the side walls 60 of the blocking device being located on opposite sides of the trigger guard 20, this engagement limits movement of the handgun 12 in the holster 12, thus stabilizing the handgun in the holster 10.

The blocking device 42 also helps to impede access to the trigger 18 when the handgun 12 is in the holster 10. Specifically, because the holster 10 is designed to accommodate not only the handgun 12 but also the light 22, the entranceway 36 of the holster body 26 is large compared to an opening that would be sized to accommodate only the handgun itself. This enlarged opening can provide inadvertent access to the handgun trigger 18—not only by a person's fingers but also by an object dropped or inserted into the holster. However, the presence of the blocking device end portion 54 adjacent to the trigger guard 20 (as best seen in FIG. 8) helps to close off some of this open space and thereby to block access to the trigger 18.

The blocking device 40, in the illustrated embodiment, does not lock in position, and does not lock the handgun in the holster 10. Once the locking mechanism 38 of the holster 10 is released, the spring 44 urges the blocking device 40 outward from the holster body, to its starting or free position as shown in FIGS. 1-4 and 7.

The invention claimed is:

1. A holster for a handgun that has at its top an ejection port and that has at its bottom a trigger guard and that has a light mounted on the handgun in front of the trigger guard, the light extending below the trigger guard, the holster comprising:

a holster body having a top wall, side walls, a bottom wall, and an end wall, the bottom wall being fixed in position relative to the top wall and side walls and end wall, the walls together defining a chamber in the holster body for receiving a portion of the handgun;

the holster body walls defining an entranceway into the chamber, opposite the end wall;

the cross-sectional dimensions of the entranceway being selected to enable insertion of the handgun including the light fully into the chamber of the holster in an insertion direction, the handgun being removable from the holster in an opposite withdrawal direction;

the holster including a handgun locking mechanism on the top wall configured to engage the handgun adjacent its ejection port when the handgun is in the holster and thereby lock the handgun in the holster;

the holster including a blocking device to press the handgun into engagement with the locking mechanism by supporting the bottom of the trigger guard;

the blocking device being supported on the holster body for movement along the bottom wall relative to the bottom wall in the insertion and withdrawal directions, between an open position and a closed position;

the blocking device having an outer end portion being located outside of the chamber and clear of the cross-section of the entranceway of the chamber when the blocking device is in the open position;

the blocking device moving from the open position to the closed position in response to insertion of the handgun through the entranceway into the chamber;

the blocking device outer end portion being located inside the chamber and within the cross-section of the entranceway when the blocking device is in the closed position;

the blocking device when in the closed position providing support to the bottom of the trigger guard thereby to press the handgun into engagement with the locking mechanism.

2. A holster as set forth in claim 1 wherein the blocking device is a one piece molded plastic member that has a flexible portion supporting the outer end portion for movement into and out of the chamber.

3. A holster as set forth in claim 2 wherein the holster bottom wall has an edge portion that cams up the blocking device outer end portion toward the holster body top wall during movement of the blocking device from the open position to the closed position.

4. A holster as set forth in claim 1 further including a spring biasing the blocking device into the open position, the spring being compressed by the blocking device during movement of the blocking device from the open position to the closed position.

5. A holster as set forth in claim 1 wherein the blocking device outer end portion has a U-shaped configuration that wraps around the sides and bottom of the handgun trigger guard when the blocking device is in the closed position.

6. A holster as set forth in claim 1 wherein:

the blocking device is a one piece molded plastic member that has a flexible portion supporting the outer end portion for movement into and out of the chamber;

the holster bottom wall has an edge portion that cams up the blocking device outer end portion toward the holster body top wall during movement of the blocking device from the open position to the closed position; and further including a spring biasing the blocking device into the open position, the spring being compressed by the blocking device during movement of the blocking device from the open position to the closed position.

7. A holster as set forth in claim 6 wherein the blocking device outer end portion has a U-shaped configuration that wraps around the sides and bottom of the handgun trigger guard when the blocking device is in the closed position.

* * * * *